US008660774B2

(12) United States Patent
Togashi et al.

(10) Patent No.: US 8,660,774 B2
(45) Date of Patent: Feb. 25, 2014

(54) ENGINE GOVERNOR

(75) Inventors: Taichi Togashi, Osaka (JP); Hideo Shiomi, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 274 days.

(21) Appl. No.: 13/258,289

(22) PCT Filed: Mar. 11, 2010

(86) PCT No.: PCT/JP2010/054127

§ 371 (c)(1),
(2), (4) Date: Sep. 21, 2011

(87) PCT Pub. No.: WO2010/110084

PCT Pub. Date: Sep. 30, 2010

(65) Prior Publication Data

US 2012/0016570 A1 Jan. 19, 2012

(30) Foreign Application Priority Data

Mar. 26, 2009 (JP) ..... 2009-077259

(51) Int. Cl.
*F02D 41/30* (2006.01)

(52) U.S. Cl.
USPC ..... 701/104; 701/110; 123/435; 123/436

(58) Field of Classification Search
USPC ..... 123/435, 436, 478, 479, 480, 482, 486, 123/490; 701/104, 110
See application file for complete search history.

(56) References Cited

U.S. PATENT DOCUMENTS

2010/0108046 A1 5/2010 Nakagawa et al.

FOREIGN PATENT DOCUMENTS

| | | | |
|---|---|---|---|
| JP | 09-282006 | 10/1997 | |
| JP | 2005-055952 | 3/2005 | |
| JP | 2006-274881 | 10/2006 | |
| JP | 2008-261307 | 10/2008 | |
| JP | 2009-042985 | 2/2009 | |
| JP | 2012-87660 | * 5/2012 | ..... F02D 45/00 |

OTHER PUBLICATIONS

International Search Report for PCT/JP2010/054127, Japanese Patent Office, mailed Apr. 6, 2010, 4 pages.

* cited by examiner

*Primary Examiner* — Hai Huynh
(74) *Attorney, Agent, or Firm* — Sterne, Kessler, Goldstein & Fox P.L.L.C.

(57) ABSTRACT

An engine governor calculates the amount of fuel supplied to an engine based on the difference in speed between the target engine speed (Nset) and actual engine speed (Nact). The amount of fuel supplied to the engine is adjusted based on the calculation results. When the difference in speed between the target engine speed (Nset) and low idle engine speed (Nlow) is equal to or less than a first predetermined speed, the difference in speed between the actual engine speed (Nact) and target engine speed (Nset) is equal to or greater than a second predetermined speed, and the calculation results are equal to or less than the minimum value of the actual engine speed (Nact), the P gain is set at a value equal to or greater than the normal value, and in cases where the I component is a negative value, the I component is set to zero.

2 Claims, 6 Drawing Sheets

AFTER
BEFORE
N
Nact
Nset
R
Ract
Rset
Rmin
P, I
P
I
A1
B1
A2
B2
0
t

ENGINE GOVERNOR

TECHNICAL FIELD

The present invention relates to an art of an engine speed control unit of an engine.

BACKGROUND ART

In PID control of engine speed, an I component is used as an integral control value by integration of speed difference between a target engine speed and an actual engine speed. In this case, when the actual engine speed is lower than the target engine speed, the integral control value of the I component is integrated continuously and increased, thereby leading an evil influence that the integral control value becomes too large.

The Patent Literature 1 discloses an electronic governor in which an integrated value is calculated based on reduction rate of the target engine speed, the speed difference between the target engine speed and the actual engine speed and the like, and a value stored previously and less than the calculated integrated value is set as the integral control value, whereby response time can be shortened in the case that the actual engine speed is reduced from high speed state to low speed state.

However, in the electronic governor disclosed in the Patent Literature 1, for example in the case that a traveling vehicle finishes traveling with actuating an engine brake, that is, in the case that the actual engine speed has been more than the target engine speed continuously by an external factor such as a downward slope and then the external factor is canceled and the actual engine speed converges on the target engine speed, it is disadvantageous that the reduction amount of the actual engine speed about the target engine speed cannot be suppressed.

Patent Literature 1: the Japanese Patent Laid Open Gazette 2006-274881

DISCLOSURE OF INVENTION

Problems to be Solved by the Invention

Then, the purpose of the present invention is to provide an engine speed control unit which can suppress the reduction amount of the actual engine speed about the target engine speed in the case that the actual engine speed has been more than the target engine speed continuously by the external factor and then the external factor is canceled and the actual engine speed converges on the target engine speed.

Means for Solving the Problems

Explanation will be given on means of the present invention for solving the problems.

According to the first aspect of the present invention, an engine governor includes a fuel supply amount calculation means calculating a supply amount of fuel to an engine based on speed difference between a target engine speed and an actual engine speed by PI control or PID control. In the case that speed difference between the target engine speed and a low idle engine speed is not more than a first predetermined engine speed, the speed difference between the actual engine speed and the target engine speed is not less than a second predetermined engine speed, and a calculated result by the fuel supply amount calculation means is not more than the minimum value of the actual engine speed, a P gain is set to be not less than a normal value, and in the case that an I component is negative, the I component is set to zero.

According to the second aspect of the present invention, in the engine governor according to the first aspect of the present invention, in the case that the speed difference between the target engine speed and the low idle engine speed is more than the first predetermined engine speed or the speed difference between the actual engine speed and the target engine speed is less than the second predetermined engine speed, the P gain is set to the normal value and the I component is set to the calculated value.

Effect of the Invention

The present invention constructed as the above brings the following effects.

The engine speed control unit of the present invention can suppress the reduction amount of the actual engine speed about the target engine speed in the case that the actual engine speed has been more than the target engine speed continuously by the external factor and then the external factor is canceled and the actual engine speed converges on the target engine speed.

DESCRIPTION OF NOTATIONS

Figure 1:
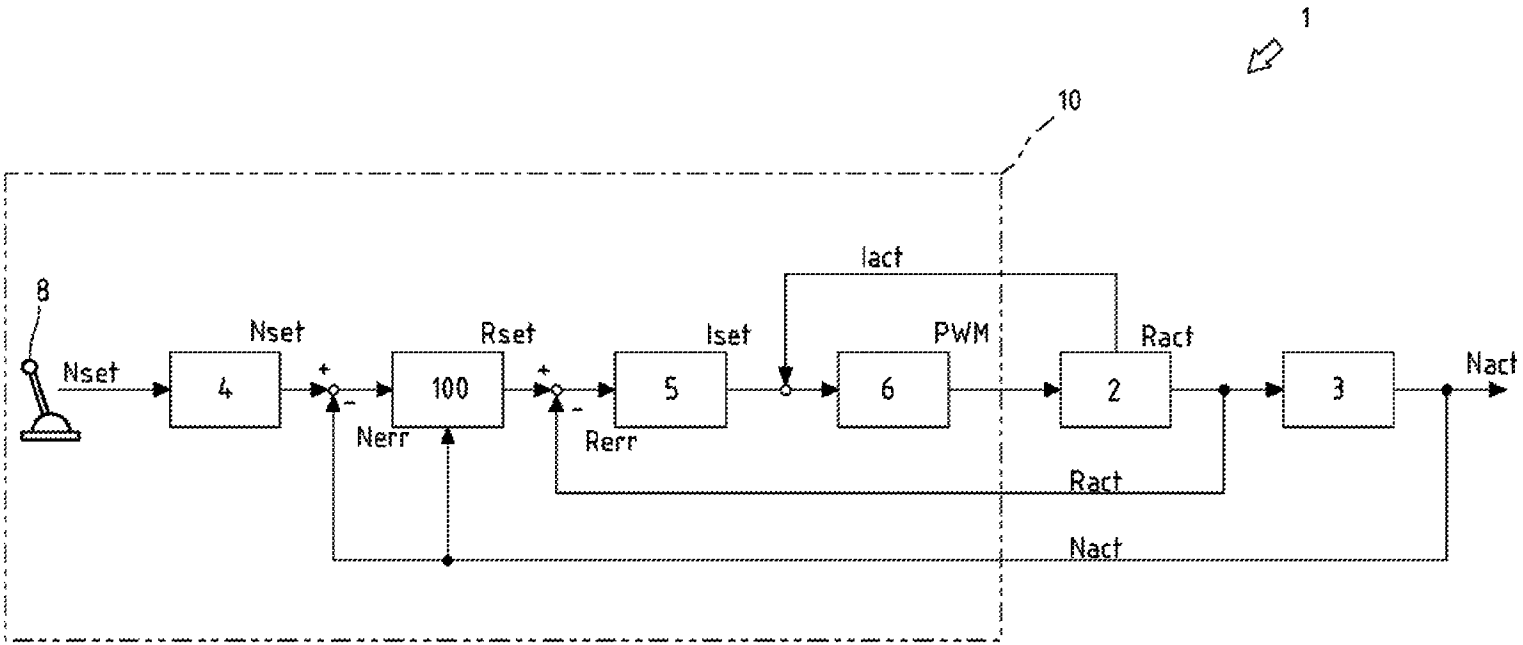
FIG. 1 It is a block diagram of construction around an engine control unit.

1 engine system
2 electronic governor
3 engine
4 filter part
5 rack position control means
6 current control part
8 accelerator lever
1 ECU
100 engine speed control part

THE BEST MODE FOR CARRYING OUT THE INVENTION

Next, explanation will be given on the mode for carrying out the present invention.

Explanation will be given on construction around an engine control unit (hereinafter, referred to as ECU) 10 according to an embodiment of the present invention referring to FIG. 1.

An engine system 1 includes an engine 3, a fuel injection device (not shown) supplying fuel to the engine 3, an electronic governor 2 which is a fuel metering means of the fuel injection device, and the ECU 10 controlling the electronic governor 2.

The ECU 10 includes an accelerator lever 8 as an engine speed set means setting a target engine speed Nset, a filter part 4 filtering electric signals from the accelerator lever 8, an engine speed control part 100 as a fuel supply amount calculation means, a rack position control means 5, and a current control part 6. The ECU 10 is electrically connected to an engine speed sensor (not shown) as an actual engine speed detection means detecting an actual engine speed Nact, a rack position sensor (not shown) detecting actual rack position Ract of the electronic governor 2, a cooling water temperature sensor (not shown) detecting temperature Tw of cooling water of the engine 3, and the like.

The engine speed control part 100 calculates a target rack position Rset of the electronic governor 2 from a speed difference Nerr between the target engine speed Nset and the actual engine speed Nact of the engine 3 by PID control. The rack is a member of the electronic governor 2 driven at the time of controlling fuel supplied to the engine 3. The construction of the engine speed control part 100 will be explained in detail later.

The rack position control means 5 calculates a target current value Iset of a solenoid for driving the rack from a displacement difference Rerr between the actual rack position Ract and the target rack position Rset of the electronic governor 2 by PID control.

The current control part 6 calculates a Pulse Width Modulation signal (hereinafter, referred to as PWM signal) for opening and closing a switching element from a current difference between an actual current value fact flowing in the solenoid for driving the rack and the target current value Iset by PID control.

Figure 2:
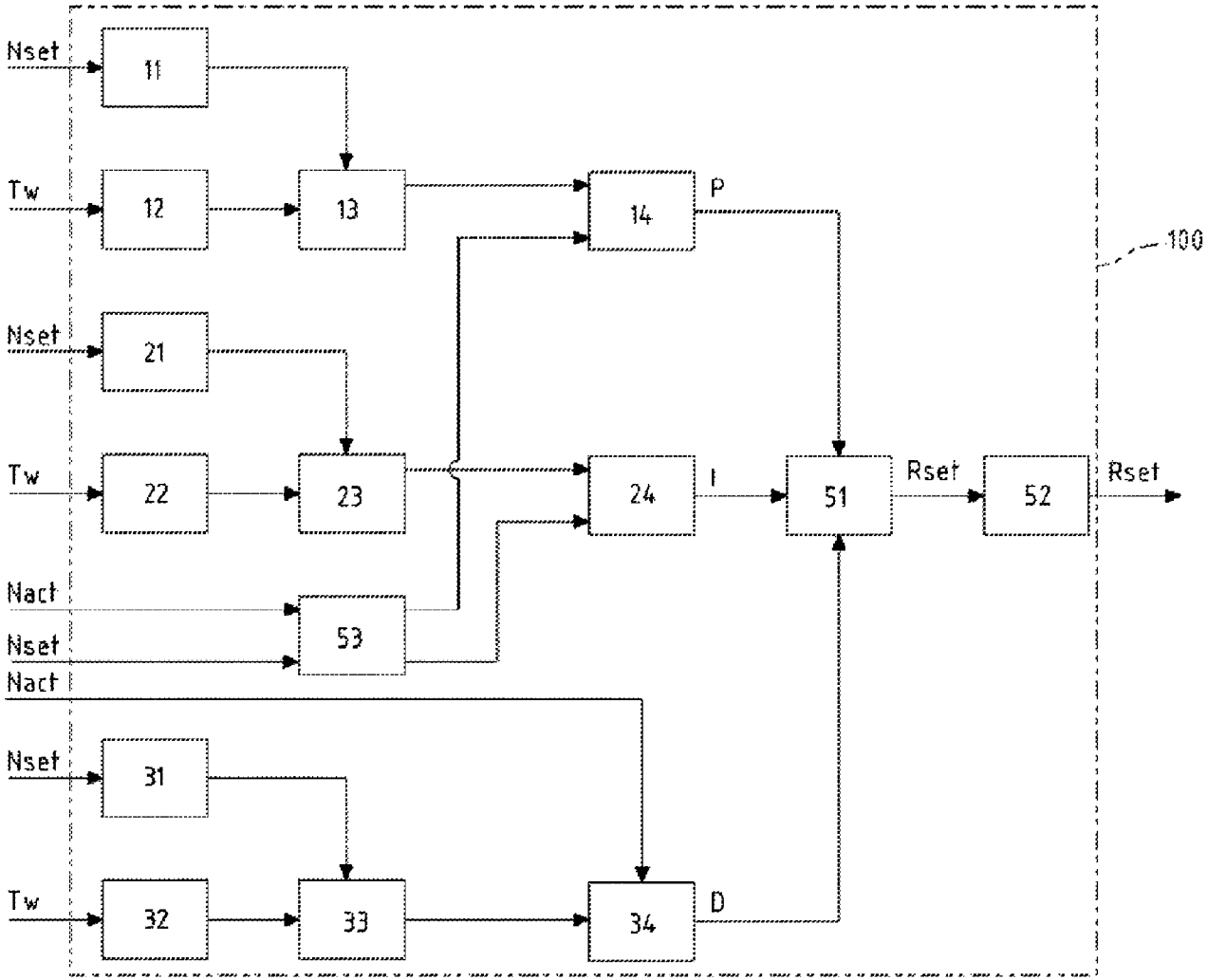
FIG. 2 It is a block diagram of construction of an engine speed control part.

Next, explanation will be given on the engine speed control part 100 in detail referring to FIG. 2.

The engine speed control part 100 includes a block calculating a P component (corresponding to P in FIG. 2), a block calculating an I component (corresponding to I in FIG. 2), a block calculating a D component (corresponding to D in FIG. 2), an adding-up part 51 adding up the calculated P component, I component and D component so as to calculate the target rack position Rset, a limit processing part 52 limiting the target rack position Rset within the range from minimum rack position Rmin to maximum rack position Rmax of the actual engine speed Nact at that time, and a speed calculation part 53 calculating the speed difference Nerr between the target engine speed Nset and the actual engine speed Nact of the engine 3.

The block calculating the P component includes a P gain map 11 calculating a P gain corresponding to the target engine speed Nset of the engine 3, a P gain water temperature correction coefficient map 12 calculating a correction coefficient of the P gain corresponding to temperature Tw of cooling water of the engine 3, a P gain calculation part 13 correcting the P gain by multiplying the P gain by the correction coefficient, and a P component calculation part 14 calculating the P component from the speed difference Nerr between the target engine speed Nset and the actual engine speed Nact of the engine 3 and the P gain after corrected.

The block calculating the I component includes a I gain map 21 calculating an I gain corresponding to the target engine speed Nset of the engine 3, an I gain water temperature correction coefficient map 22 calculating a correction coefficient of the I gain corresponding to temperature Tw of cooling water of the engine 3, an I gain calculation part 23 correcting the I gain by multiplying the I gain by the correction coefficient, and an I component calculation part 24 calculating the I component from integrated value by the integration of the speed difference Nerr between the target engine speed Nset and the actual engine speed Nact of the engine 3 and the I gain after corrected. The I component calculation part 24 performs windup procession in which update of the I component is stopped when the target rack position Rset reaches the minimum rack position Rmin or the maximum rack position Rmax.

The block calculating the D component includes a D gain map 31 calculating a D gain corresponding to the target engine speed Nset of the engine 3, a D gain water temperature correction coefficient map 32 calculating a correction coefficient of the D gain corresponding to temperature Tw of cooling water of the engine 3, a D gain calculation part 33 correcting the D gain by multiplying the D gain by the correction coefficient, and a D component calculation part 34 calculating the D component from the actual engine speed Nact of the engine 3 and the D gain after corrected.

According to the construction, the engine speed control part 100 calculates the target rack position Rset based on the gains corresponding to the target engine speed Nset of the engine 3 and the temperature Tw of cooling water of the engine 3, and the speed difference Nerr between the target engine speed Nset and the actual engine speed Nact of the engine 3.

Figure 3:
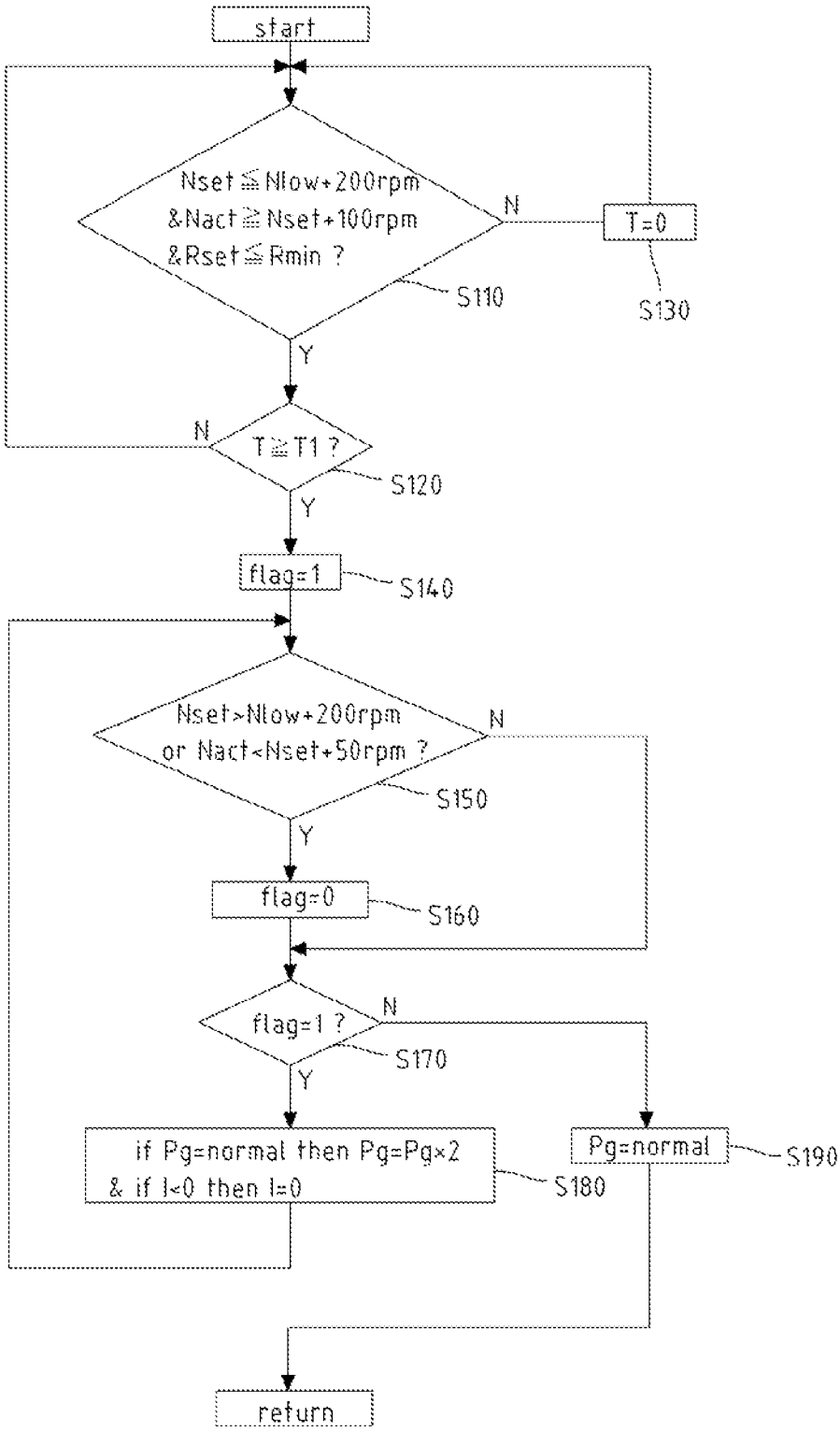
FIG. 3 It is a flow chart of control mode of sudden speed reduction control.

Next, explanation will be given on sudden speed reduction control of the ECU 10 referring to FIG. 3.

At S110, as a sudden speed reduction control starting condition, in the case that the speed difference between the target engine speed Nset of the engine 3 and a low idle engine speed (an idle engine speed which is set to the minimum speed by the accelerator lever 8) Nlow is not more than 200 rpm corresponding to a first predetermined engine speed and the speed difference between the actual engine speed Nact and the target engine speed Nset of the engine 3 is not less than 100 rpm corresponding to a second predetermined engine speed, and the target rack position Rset is not more than the minimum rack position Rmin (not more than the minimum value at which the fuel supply amount calculated by the engine speed control part 100 is permitted at the actual engine speed Nact of the engine 3) corresponding to the actual engine speed Nact at that time, the ECU 10 judges that the sudden speed reduction control starting condition is satisfied and shifts to S120. When the sudden speed reduction control starting condition is not satisfied, the ECU 10 shifts to S130.

At S120, the ECU 10 starts addition of an engine brake timer T. When the engine brake timer T becomes not less than 1 second, the ECU 10 judges that a count up condition is satisfied and the control shifts to S140. When the count up condition is not satisfied, the ECU 10 shifts to S110 again.

At S130, the ECU 10 resets the engine brake timer T and shifts to S110 again.

At S140, the ECU 10 sets an engine brake flag (flag=1). "Setting the engine brake flag" is information of control showing that the condition mentioned above is satisfied at the time of actuating the engine brake.

At S150, as a sudden speed reduction control release condition, in the case that the speed difference between the target engine speed Nset of the engine 3 and a low idle engine speed Nlow is more than 200 rpm corresponding to the first predetermined engine speed, or the speed difference between the actual engine speed Nact and the target engine speed Nset of the engine 3 is less than 50 rpm, that is, the actual engine speed Nact converges on the target engine speed Nset, the ECU 10 judges that the sudden speed reduction control release condition is satisfied and shifts to S160. When the sudden speed reduction control release condition is not satisfied, the ECU 10 shifts to S170.

At S160, the ECU 10 releases the engine brake flag (flag=0). "Releasing the engine brake flag" means that the information of control showing that the condition mentioned above is satisfied at the time of actuating the engine brake is reset.

At S170, as a sudden speed reduction control processing condition, in the case that the engine brake flag is set (flag=1), the ECU 10 judges that the sudden speed reduction control processing condition is satisfied and shifts to S180. When the engine brake flag is released (flag=0), the ECU 10 judges that the sudden speed reduction control processing condition is not satisfied and the control shifts to S190.

At S180, when the P gain (corresponding to Pg in the drawing) is a normal value (normal), the ECU 10 calculates the P component by doubling the P gain as a gain value corresponding to a predetermined value not less than the normal value (normal). In this case, when the I component (corresponding to I in the drawing) is less than 0, the I component is set to zero. Then, the ECU 10 shifts to S150 and repeats the judgment of the sudden speed reduction control release condition. Herein, the normal value (normal) is the P gain (the P gain determined from the target engine speed Nset, the P gain map 11 and the P gain water temperature correction coefficient map 12) calculated by the P gain calculation part 13.

At S190, the ECU 10 set the P gain to be the normal value (normal), set the I component to be the normal calculated value (the value calculated based on the I gain determined by the target engine speed Nset, the I gain map 21 and the I gain water temperature correction coefficient map 22 and the integrated value of the speed difference Nerr between the actual engine speed Nact and the target engine speed Nset) calculated by the I component calculation part 24 (not shown), and judges again whether the sudden speed reduction control must be repeated or not from S110.

According to the construction, the state at which the actual engine speed Nact of the engine 3 is larger than the target engine speed Nset is continued by the external factor. Then, when the external factor is canceled and the actual engine speed Nact of the engine 3 converges on the target engine speed Nset, the reduction amount of the actual engine speed Nact of the engine 3 about the target engine speed Nset can be suppressed. For example, in the case that a traveling vehicle finishes traveling by actuating the engine brake, the actual engine speed Nact of the engine 3 can converge on the target engine speed Nset rapidly. In the case that the necessity of suppressing the influence of calculation of the I component is canceled, the PID control can be recovered.

Figure 5:
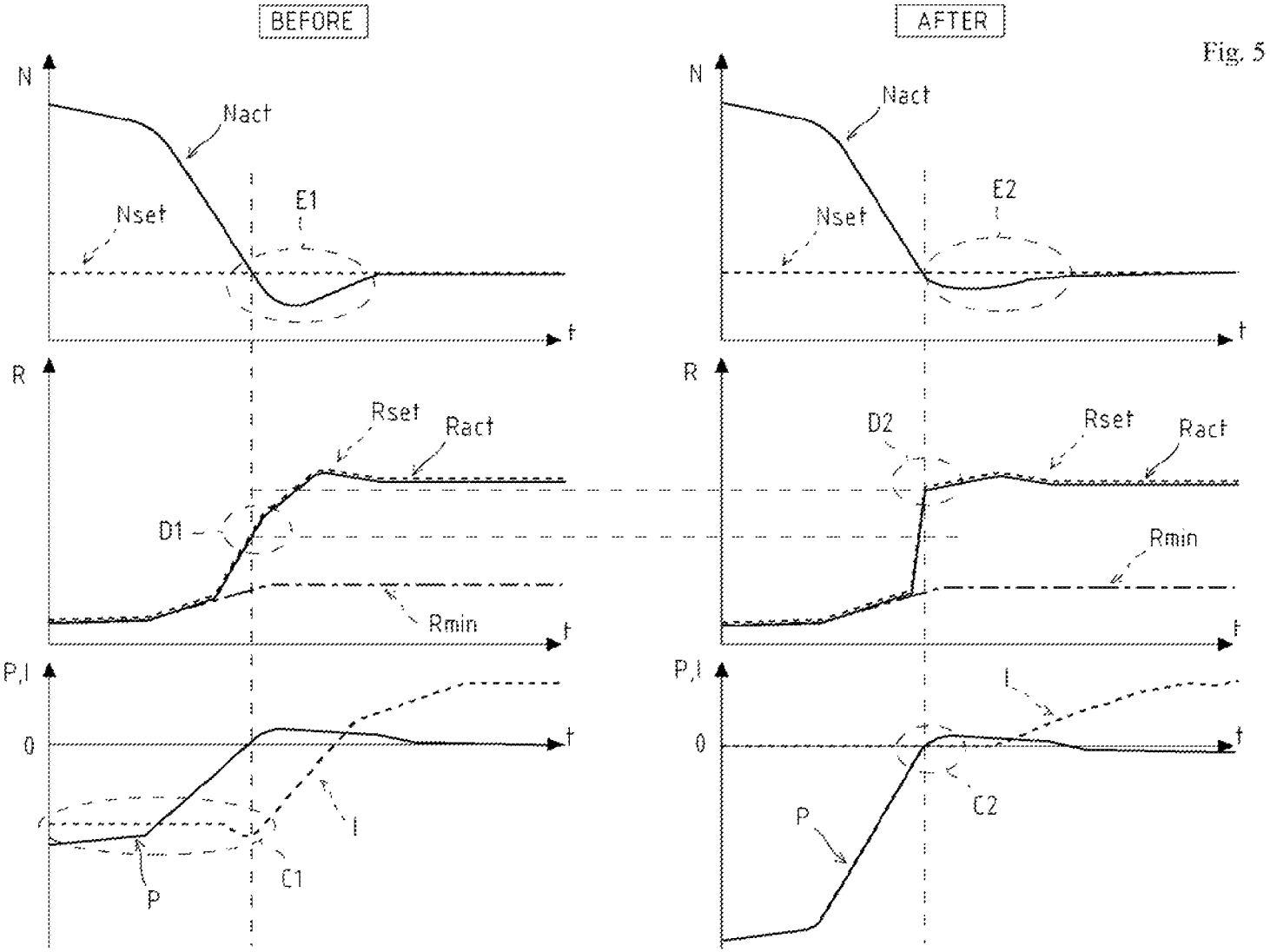
FIG. 5 It is a graph in which a part of FIG. 4 is enlarged.
Figure 6:
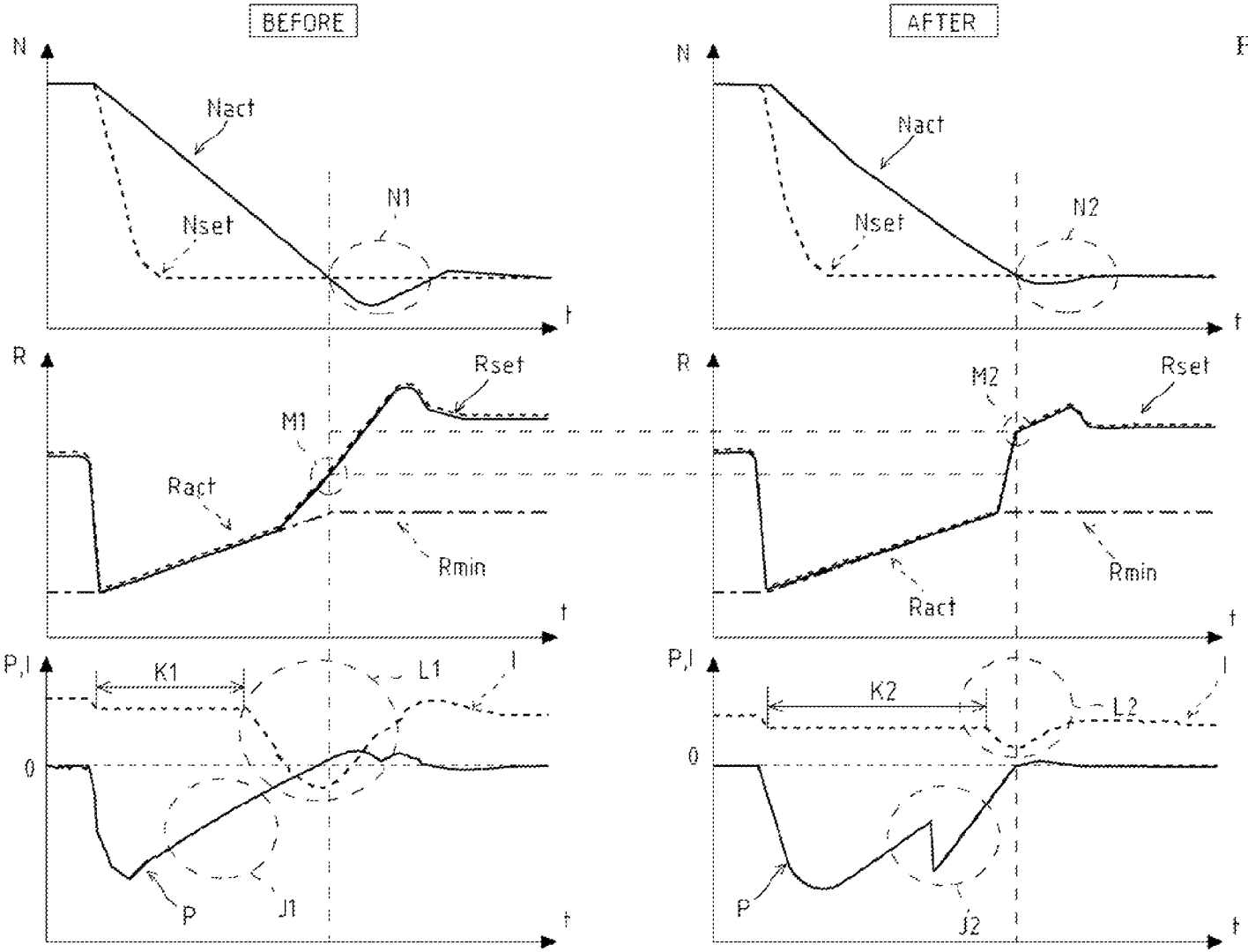
FIG. 6 It is a graph of another effect of the sudden speed reduction control.

Explanation will be given on the effect of the sudden speed reduction control referring to FIGS. 4 to 6. Each of FIGS. 4 to 6 is a time series graph showing comparison of the state before executing the sudden speed reduction control (BEFORE in the drawing) and the state after executing the sudden speed reduction control (AFTER in the drawing) about an engine speed N (in the drawing, the solid line shows the actual engine speed Nact and the broken line shows the target engine speed Nset), rack position R (in the drawing, the solid line shows the actual rack position Ract and the broken line shows the target rack position Rset) and the PI component (in the drawing, the solid line shows the P component and the broken line shows the I component) from the upper side to the lower side of the drawing.

Figure 4:
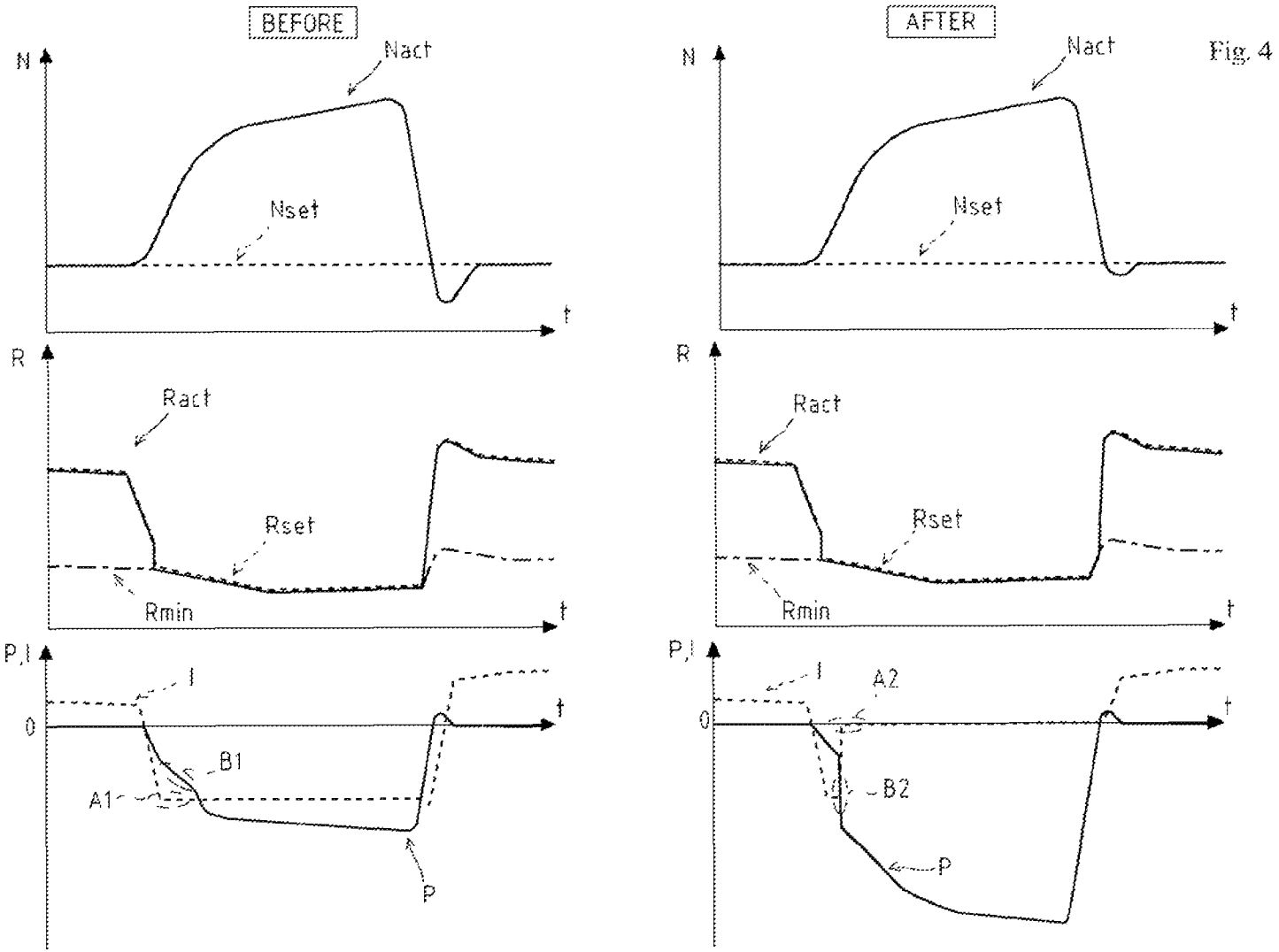
FIG. 4 It is a graph of the effect of the sudden speed reduction control.

FIG. 4 is a graph of the state at which the actual engine speed Nact of the engine 3 has been larger continuously than the target engine speed Nset by the external factor and then the external factor is canceled and the actual engine speed Nact of the engine 3 converges on the target engine speed Nset. FIG. 5 is a graph enlarging the part in which the actual engine speed Nact of the engine 3 converges on the target engine speed Nset after canceling the external factor at the same state. FIG. 6 is a graph of the state at which the target engine speed Nset of the engine 3 is changed suddenly from the maximum speed to the minimum speed.

As shown by the graph of the engine speed N in FIG. 4, the actual engine speed Nact of the engine 3 has been continuously larger than the target engine speed Nset by the external factor, and then converges on the target engine speed Nset because the external factor is canceled. In this case, as shown by the graph of the PI component in FIG. 4, the sudden speed reduction control doubles the P component (B1 and B2 in FIG. 4) and makes the I component be zero (A1 and A2 in FIG. 4).

By doubling the P component as mentioned above, the target rack position Rset has been set to the minimum rack position Rmin for the longer period than that of the conventional construction, whereby the windup procession stopping the calculation of the I component is effective for the longer period so that the integration stopping period of the I component is extended. Furthermore, the I component is reset when the I component is negative (C1 and C2 in FIG. 5), whereby, as shown by the graph of the rack position R in FIG. 5, the target rack position Rset reaches an appropriate value quickly so that the actual rack position Ract reaches an appropriate value quickly (D1 and D2 in FIG. 5). Therefore, as shown by the graph of the engine speed N in FIG. 5, the actual engine speed Nact of the engine 3 converges quickly on the target engine speed Nset (E1 and E2 in FIG. 5).

As shown by the graph of the engine speed N in FIG. 6, the target engine speed Nset of the engine 3 is changed suddenly from the maximum speed to the minimum speed. In this case, as shown by the graph of the PI component in FIG. 6, by doubling the PI component by the sudden speed reduction control (J1 and J2 in FIG. 6), the target rack position Rset has been set to the minimum rack position Rmin for the longer period than that of the conventional construction, whereby the windup procession stopping the calculation of the I component is effective for the longer period so that the integration stopping period of the I component is extended (change of K1 and K2 in FIG. 6). Then, the reduction amount of the I component is also reduced, whereby the I component is prevented from being negative (change of L1 and L2 in FIG. 6). Accordingly, as shown by the graph of the rack position R in FIG. 6, the target rack position Rset reaches an appropriate value quickly so that the actual rack position Ract reaches an appropriate value quickly (M1 and M2 in FIG. 6), whereby the actual engine speed Nact converges quickly on the target engine speed Nset as shown by the graph of the engine speed N in FIG. 6 (N1 and N2 in FIG. 6).

As mentioned above, even if the target engine speed Nset of the engine 3 is changed suddenly from the maximum speed to the minimum speed, the reduction amount of the actual rack position Ract of the engine 3 about the target rack position Rset can be suppressed. For example, when the accelerator lever 8 is operated to the speed reduction side suddenly, the actual engine speed Nact of the engine 3 converges quickly on the target engine speed Nset.

INDUSTRIAL APPLICABILITY

The present invention can be employed for an engine speed control unit of an engine.

The invention claimed is:

1. An engine governor comprising:

a fuel supply amount calculation means calculating a supply amount of fuel to an engine based on speed difference between a target engine speed and an actual engine speed by PI control or PID control, characterized in that in the case that speed difference between the target engine speed and an idle engine speed which is set to the minimum speed by an engine speed set means is not more than a first predetermined engine speed, the speed difference between the actual engine speed and the target engine speed is not less than a second predetermined engine speed, and a fuel supply amount calculated by the fuel supply amount calculation means is not more than the permissible minimum value of the actual engine speed, a P gain is set to be not less than a value determined from the target engine speed, a P gain map and a P gain water temperature correction coefficient map, and in the case that an I component is negative, the I component is set to zero.

2. The engine governor according to claim 1, wherein in the case that the speed difference between the target engine speed and the idle engine speed which is set to the minimum speed by an engine set means is more than the first predetermined engine speed or the speed difference between the actual engine speed and the target engine speed is less than the second predetermined engine speed, the P gain is set to the value determined from the target engine speed, the P gain map and the P gain water temperature correction coefficient map and the I component is set to the value calculated based on an I gain determined by the target engine speed, an I gain map and an I gain water temperature correction coefficient map and an integrated value of speed difference between the actual engine speeds and the target engine speed.

* * * * *

UNITED STATES PATENT AND TRADEMARK OFFICE

CERTIFICATE OF CORRECTION

PATENT NO. : 8,660,774 B2
APPLICATION NO. : 13/258289
DATED : February 25, 2014
INVENTOR(S) : Togashi et al.

It is certified that error appears in the above-identified patent and that said Letters Patent is hereby corrected as shown below:

In the Claims

Claim 2 at Column 7, Line 21, “an engine set means” should read --an engine speed set means--.

Claim 2 at Column 7, Line 31, “engine speeds” should read --engine speed--.

Signed and Sealed this
Eighth Day of July, 2014

Michelle K. Lee

Michelle K. Lee
*Deputy Director of the United States Patent and Trademark Office*